United States Patent [19]

Moriyama et al.

[11] 4,242,811

[45] Jan. 6, 1981

[54] THERMO-PNEUMATIC UNIT AND APPARATUS FOR THERMAL TREATMENT OF TRAVELLING FLAT MATERIALS

[75] Inventors: Aritsune Moriyama, Nishinomiya; Kunio Kida, Kasai, both of Japan

[73] Assignee: Sanko Air Plant, Ltd., Osaka, Japan

[21] Appl. No.: 766

[22] Filed: Jan. 3, 1979

[30] Foreign Application Priority Data

Jan. 7, 1978 [JP] Japan ..... 53-000712

[51] Int. Cl.[3] ..... F26B 15/22

[52] U.S. Cl. ..... 34/150; 34/151; 34/216; 68/5 D; 68/20

[58] Field of Search ..... 34/150, 151, 216, 217, 34/66; 68/20, 5 C, 5 D, 5 E; 98/116

[56] References Cited

U.S. PATENT DOCUMENTS

| | | | |
|---|---|---|---|
| 1,669,275 | 5/1928 | Ayres et al. | 34/216 |
| 2,109,425 | 2/1938 | Hurxthal | 34/151 |
| 2,197,776 | 4/1940 | Argabrite et al. | 34/216 |
| 2,279,425 | 4/1942 | Voysey | 98/116 |
| 3,075,297 | 1/1963 | Argabrite et al. | 34/150 |
| 3,228,113 | 1/1966 | Fannon, Jr. | 34/216 |

FOREIGN PATENT DOCUMENTS

| | | | |
|---|---|---|---|
| 628917 | 4/1936 | Fed. Rep. of Germany | 34/150 |

*Primary Examiner*—Larry I. Schwartz

*Attorney, Agent, or Firm*—Burgess, Ryan and Wayne

[57] ABSTRACT

A thermo-pneumatic unit for thermal treatment of moving flat materials such as a drying process for cowhides includes a blower which is located on one side of the travelling path of the materials and adapted for generation of thermally adjusted air flow having specified initial direction and mass velocity distribution so that larger mass velocity is focussed upon the portion of each material requiring higher rate of thermal treatment. Ideally, an even thermal effect is obtained over the entire parts of each material and thermal energy loss is effectively avoided even when the material has initial local variance in moisture content or temperature. A collector for blown air on the other side of the travelling path collects the blown air, which assures higher evenness in thermal effect with less thermal energy loss. A thermo-pneumatic apparatus includes a plurality of successive chamber sections for travel of the material, each having one unit in such an arrangement that the thermally adjusted air flows alternately in opposite directions from section to section, thereby equalizing the thermal effect on both lateral sides of each material as it travels from section to section.

2 Claims, 10 Drawing Figures

THERMO-PNEUMATIC UNIT AND APPARATUS FOR THERMAL TREATMENT OF TRAVELLING FLAT MATERIALS

BACKGROUND OF THE INVENTION

The present invention relates to a improved thermo-pneumatic unit and apparatus for thermal treatment of moving flat animal hides, and more particularly relates to a improvement in arrangements for processing a plurality of mutually spaced flat animal hides such as cowhides along a prescribed travelling path under application of drying by means of forced entry of heated air flow into spaces between the successive flat animal hides.

Taking the drying process of cowhides as a typical example, a plurality of panels on which cowhides are disposed in a flat spreaded disposition travel along a prescribed path longitudinally through an elongated drying chamber. The panels are suspended from overhanging guide rails in a mutually spaced relationship to each other with their planes extending perpendicular to the direction of travel. Heat is applied to the moving cowhides by a floor heater. In the conventional arrangement, a number of axial-flow fans or parallel air flow blowers are arranged on one lateral side of and along the travelling path in order to generate flow of the air in the spaces between the successive panels, thereby evening the thermal effect over the entire cowhide. Especially in practice, a cowhide is generally comprised of a number of local portions of initially different moisture content. Consequently, properly rated heating at one local portion of the cowhide often tends to cause undesirable overheating and/or insufficient heating at other local portions of the cowhide. Such locally uneven thermal treatment on the cowhide leads to an inevitable degradation in quality of the cowhide after the treatment, and a substantial loss in thermal energy. That is, in the case of animal hides such as cowhides having geographical variance in moisture content or thermal capacity, different local portions of the animal hide require application of differently rated thermal treatment even using a common supply source of the heated air flow.

SUMMARY OF THE INVENTION

It is one object of the present invention to enable ideally even drying of flat animal hides successively transported along a prescribed path of travel by means of forced entry of thermally adjusted air flow into spaces between the successive flat animal hides.

It is another object of the present invention to enable application of differently rated thermal treatment even using a common supply source of the thermally adjusted air when the animal hide has geographical variance in moisture content or thermal capacity.

It is another object of the present invention to minimize thermal energy loss in thermal treatment of flat animal hides successively moving along a prescribed path of travel by means of use of a thermally adjusted air flow.

In accordance with one aspect of the present invention, a thermo-pneumatic unit includes a blower which is located on one lateral side of the path of travel of flat animal hides and adapted for generation of thermally adjusted air flow having a specified initial direction and mass velocity distribution in accordance with the geographical distribution of the moisture content and thermal capacity in the animal hides.

In accordance with another aspect of the present invention, the thermo-pneumatic unit further includes a collecter which is located on the other lateral side of the travelling path of the flat animal hides at a position corresponding to that of the blower and adapted for positive collection of the blown air.

In accordance with another aspect of the present invention, a thermo-pneumatic apparatus includes a chamber for travel of flat animal hides and which is provided with a plurality of successively arranged sections. Each section is provided with one unit of the above-described type in such an arrangement that the thermally adjusted air flows alternately in opposite directions from section to section.

DESCRIPTION OF THE PREFERRED EMBODIMENTS

Figure 1:
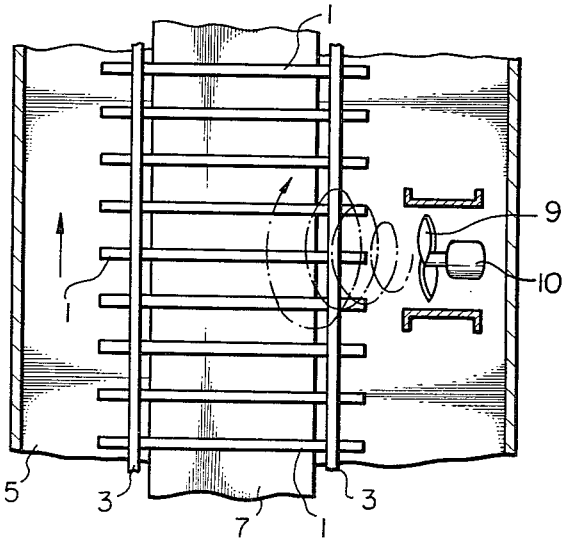
Fig. 1 PRIOR ART
FIG. 1 is a plan view of one example of the conventional arrangement for drying of cowhides.

One example of the conventional floor heater type thermo-pneumatic unit for drying of cowhides is shown in FIG. 1, in which a plurality of enameled iron panels 1 travel along overhanging guide rails 3 which are extended in the longitudinal direction of a drying chamber 5. The direction of travel of the panels 1 is shown by an arrow. The panels 1 are suspended from the guide rail 3 in spaced relationship from each other and driven by a suitable known drive mechanism not shown in the drawing. A heater 7 is arranged on the floor of the drying chamber 5 below the travelling path of the panels 1. Each panel 1 carries cowhides flatly spread over both flat surfaces thereof. An axial-flow fan 9 is arranged beside the travelling path of the panels 1 and driven by an associated drive motor 10. The fan 9 is adapted for stirring and revolving the hot air heated by the floor heater 7 within the drying chamber 5.

Thus, a revolving flow of hot air is generated by rotation of the fan 9 as shown in phantom in the drawing. Due to this revolving flow, the hot air is widely dispelled in the area of the drying chamber 5 around the position of the fan 9, i.e., the area close to one side terminal of each panel 1. In practice, however, the revolving flow of hot air impinges against the terminal sections of the travelling panels closer to the fan 9, thereby seriously blocking smooth and deep entry of the hot air into the spaces between the successive panels carrying the cowhides. Therefore, the hot air can hardly reach the center part of the cowhides on the panels 1. That is, the conventional thermo-pneumatic unit of the above-described type cannot assure a sufficient, even overall drying effect on the cowhides. This disadvantage is caused by the revolving nature of the hot air used for drying.

Figure 2:
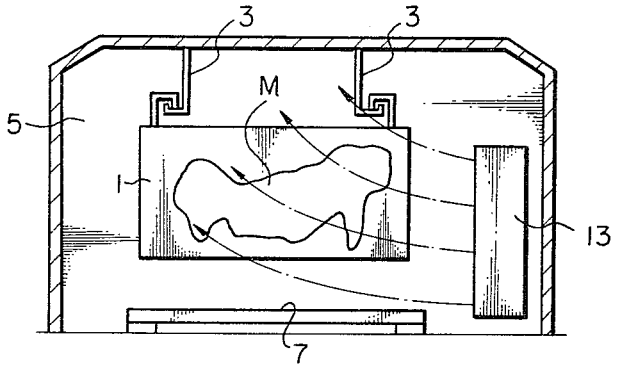
Fig. 2 PRIOR ART
FIG. 2 is an end view, partly in section, of another example of the conventional arrangement for drying of cowhides.

Another example of the conventional floor heater type thermo-pneumatic unit for drying of cowhides is depicted in FIG. 2, in which the panels 1 carrying the cowhides M moves along the overhang guide rails 3 through the drying chamber 1 just as in the foregoing example, the heater 7 being arranged on the floor below the travelling path of the panels 1. In this case, however, a blower 13 creating parallel air flow with uniform velocity distribution is arranged beside and at a position somewhat lower than the travelling path of the panels 1 in order to positively supply the parallel air flow into the spaces between the successive panels 1. In this case, the air flow has a tendency to be biased upwards as shown in phantom particularly in the area of each space remote from the blower 13 due to the heat generated by the floor heater 7. Due to such a biased flow of the hot air, this unit cannot assure an overall uniform drying effect on the cowhides M travelling with the panels 1. Only the portion of each cowhide M closer to the blower 13 is often overheated and, therefore, degraded in quality. The biased flow of the hot air results in loss of thermal energy also. This disadvantage is caused by the uniform mass velocity distribution of the air flow used for drying.

Figure 3:
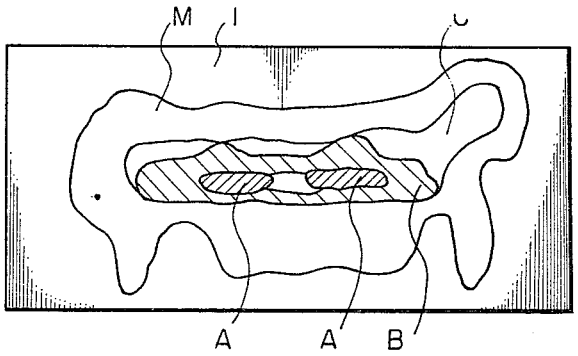
FIG. 3 is an explanatory view for showing geographical variance in moisture content of a cowhide.

The moisture content of a cowhide M in general varies from portion to portion of the cowhide M. As shown in FIG. 3, the cowhide M includes portions A of high moisture content and located in the center part of the cowhide M, a portion B of moderate moisture content and surrounding the high moisture content portion A, and a portion C of low moisture content and surrounding the moderate moisture content portion B. When drying of the cowhide M is carried out under common environmental and process conditions, about six hours are needed for sufficient drying of the high moisture content portion A, about three hours for the moderate moisture content portion B, and about one hour for the low moisture content portion C. Therefore, sufficient drying of the high moisture content portion A is inevitably accompanied by excessive drying of the remaining portions B and C, thereby causing serious degradation in quality of the cowhide and a substantial loss in the thermal energy.

Figure 4A:
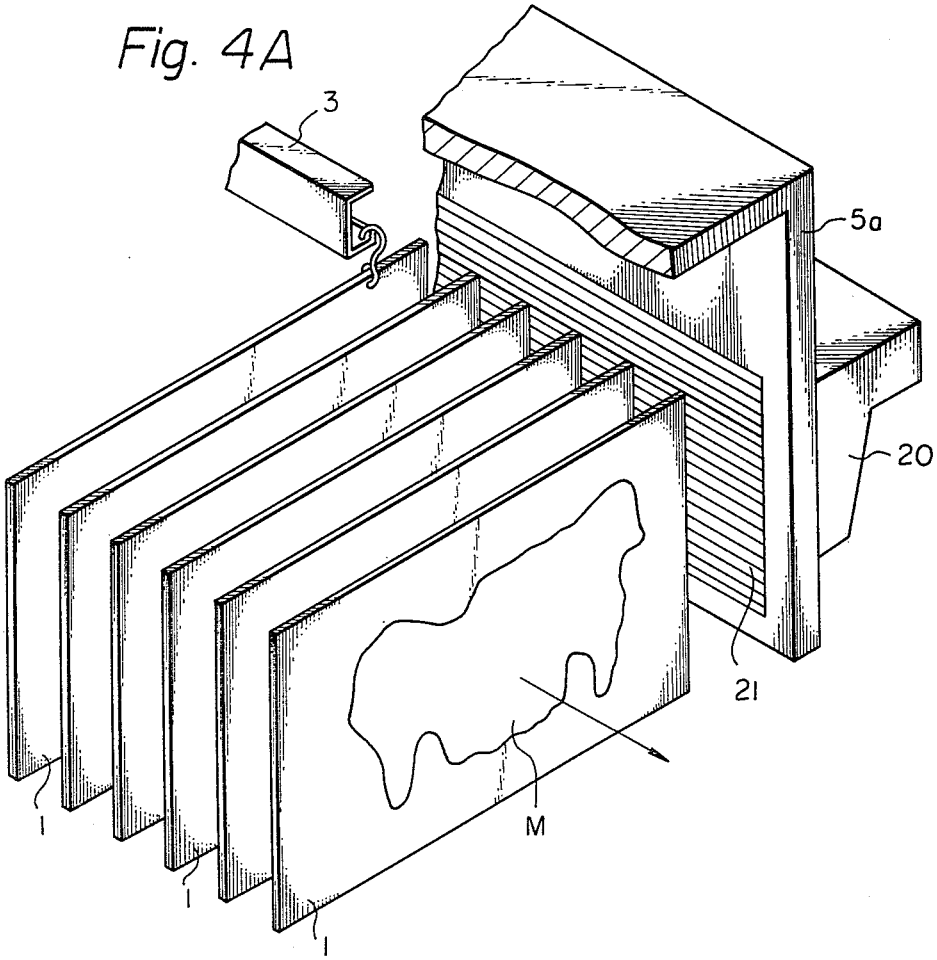
FIG. 4A is a perspective view, partly omitted, of one embodiment of the thermo-pneumatic unit in accordance with the present invention.
Figure 4B:
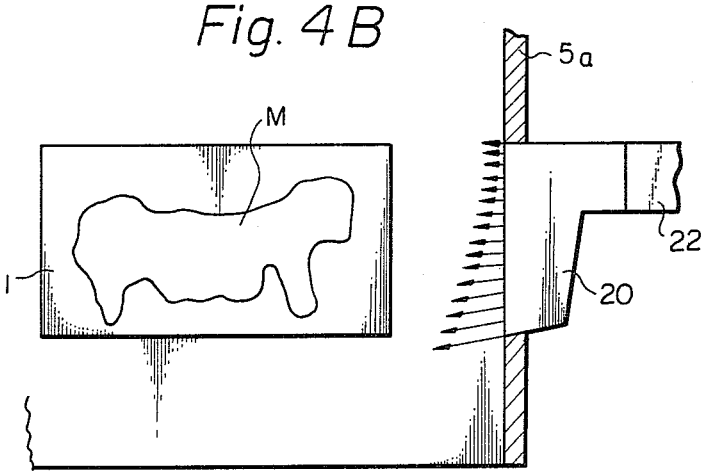
FIG. 4B is an explanatory view for showing mass velocity distribution of hot air flow in accordance with the present invention.

One embodiment of the thermo-pneumatic unit in accordance with the present invention is shown in FIGS. 4A and 4B, in which cowhides M on the panels 1 move along the overhang guide rails 3 as shown with an arrow. A hot air blower 20 is mounted to one side wall 5*a* of the drying chamber 5 with its outlet 21 facing one side of the travelling path of the panels 1. The hot air blower 20 is connected to a given supply source (not shown) of hot air via a duct 22. The outlet 21 of the hot air blower 20 is provided with a number of horizontal lattices extending in the direction of travel of the panels 1. Though not shown in the drawings, the hot air blower 20 is internally provided with a known rectifier mechanism in order to generate a parallel flow of hot air. The hot air blower 20 is so constructed that the hot air flows somewhat downwards and mass velocity of the hot air increases gradually in the lower side of the current flow as schematically shown in FIG. 4B.

Figure 5:
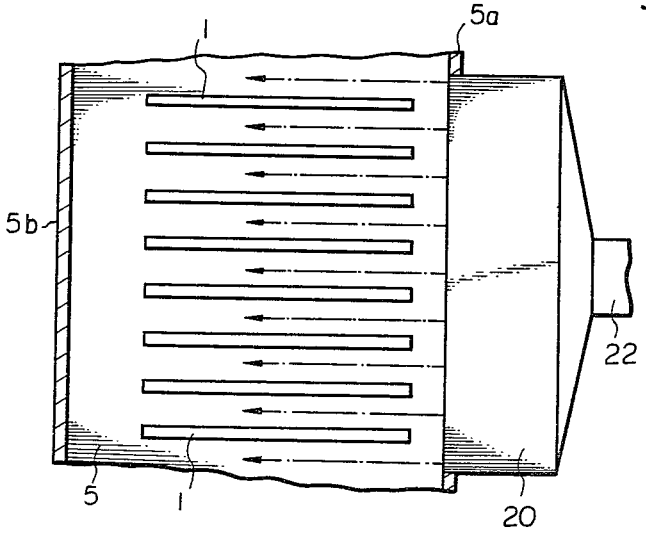
FIG. 5 is a plan view, partly in section, of the thermopneumatic unit shown in FIG. 4.
Figure 6:
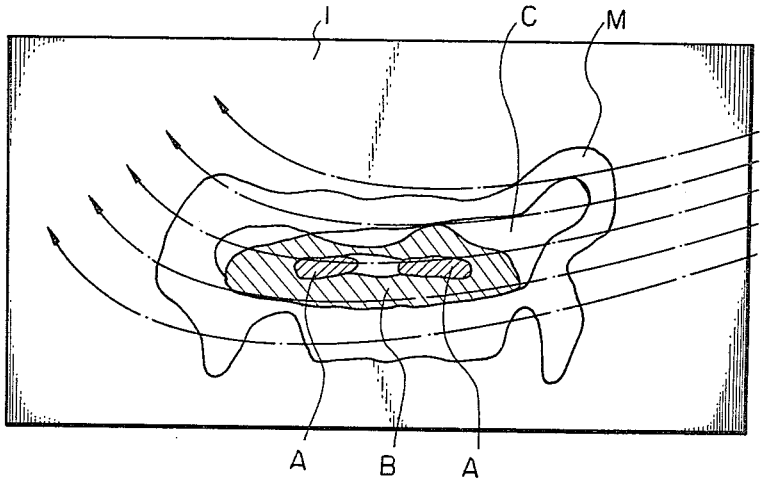
FIG. 6 is an explanatory view for showing the flowing mode of hot air when the thermo-pneumatic unit shown in FIGS. 4 and 5 is used for drying of cowhides.

The flowing mode of the hot air generated by the blower 20 is illustrated in FIGS. 5 and 6. As shown in phantom in FIG. 5, the hot air flows through the spaces between successive panels 1 towards the other side wall 5*b* of the drying chamber 5. Just after leaving the outlet 21 of the blower 20, the hot air has a tendency to flow downwards due to the purposely inclined mounting of the lattices and, upon arrival at the center area of each space between the successive panels 1, has a tendency to flow upwards due to its own high temperature as shown in FIG. 6. Owing to such a curved flowing path of the hot air, a supply of the hot air with larger mass velocity is focused upon the high moisture content portion A in the center part of the cowhide M. Concurrently with this, supply of the hot air with smaller mass velocity is focused upon the low moisture content portion C in the peripheral part of the cowhide M.

Consequently, the hot air is blown on the cowhide in such a way that a low rate of drying is applied to the low moisture content portion whereas a high rate of drying is applied to the high moisture portion in order to eliminate the initial local variance in moisture content. In other words, ideally, an even drying effect can be obtained over the entire cowhide without any overheating of the low moisture content portion and a substantial loss in thermal energy.

Figure 7:
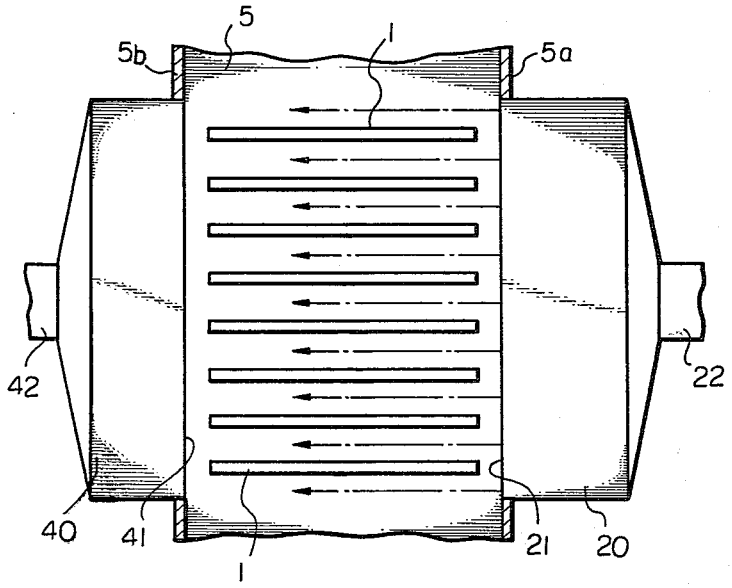
FIG. 7 is a plan view, partly in section, of another embodiment of the thermo-pneumatic unit in accordance with the present invention.

Another embodiment of the thermo-pneumatic unit in accordance with the present invention is shown in FIG. 7, in which the unit is provided, in addition to the hot air blower 20, with a hot air collector 40 in order to positively collect the hot air generated by the hot air blower 20. The hot air collector 40 is mounted to the opposite side wall 5*b* and provided with an inlet 41 opening in the drying chamber 5 at a position corresponding to the position of the outlet 21 of the hot air blower 20. This hot air collector 40 is connected to a given suction source of the hot air via a duct 42. Like the outlet 21 of the hot air blower 20, the inlet 41 of the hot air collector 40 is provided with a number of horizontal lattices extending in the direction of travel of the panels 1.

The total effective opening surface area of the inlet 41 of the hot air collector 40 is smaller than that of the outlet 21 of the hot air blower.

Construction and arrangement of the hot air blower 20 are the same with those of the one used in the first embodiment.

Figure 8:
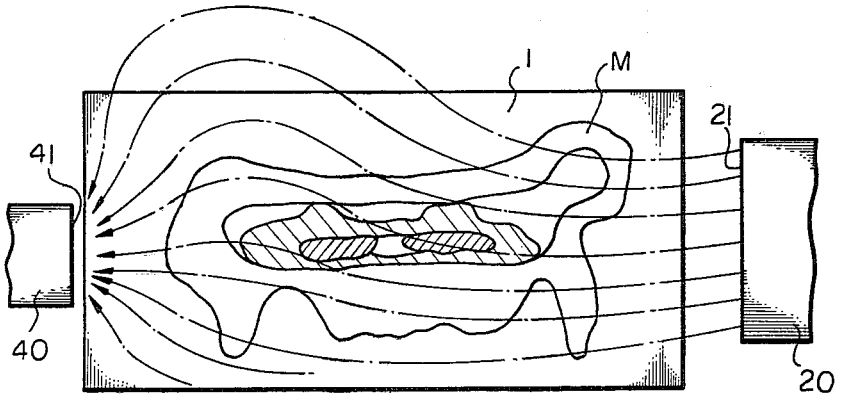
FIG. 8 is an explanatory view for showing the flowing mode of hot air when the thermo-pneumatic unit shown in FIG. 7 is used for drying of cowhides.

The flowing mode of the hot air in this embodiment is schematically shown in FIG. 8. In the area of the space closer to the hot air blower 20, the hot air flows in a manner similar to that shown in FIG. 6 for the first embodiment, and has a tendency to flow upwards as it approaches the area of the space closer to the hot air collector 40. However, the positive suction by the hot air collector causes the hot air to converge towards the inlet 41 of the hot air collector 40, thereby successfully constraining the upward flow of the hot air.

The hot air collected by the hot air collector 40 may be circulated to the supply source of the hot air blower 20 for recycling purposes, thereby enabling effective utilization of thermal energy.

Owing to the convergence of the hot air on the side of the space remote from the hot air blower 20, this embodiment assures a more even drying effect over the entire cowhide with a considerably reduced loss in thermal energy.

Generally in practice, a drying chamber 5 for cowhides extends over a distance from 40 to 60 meters. In order to apply the present invention to the drying chamber 5 of such a long construction, the drying chamber 5 is divided into a number of sections arranged along the length of the entire construction, each section being provided with a thermo-pneumatic unit in accordance with the present invention.

Figure 9:
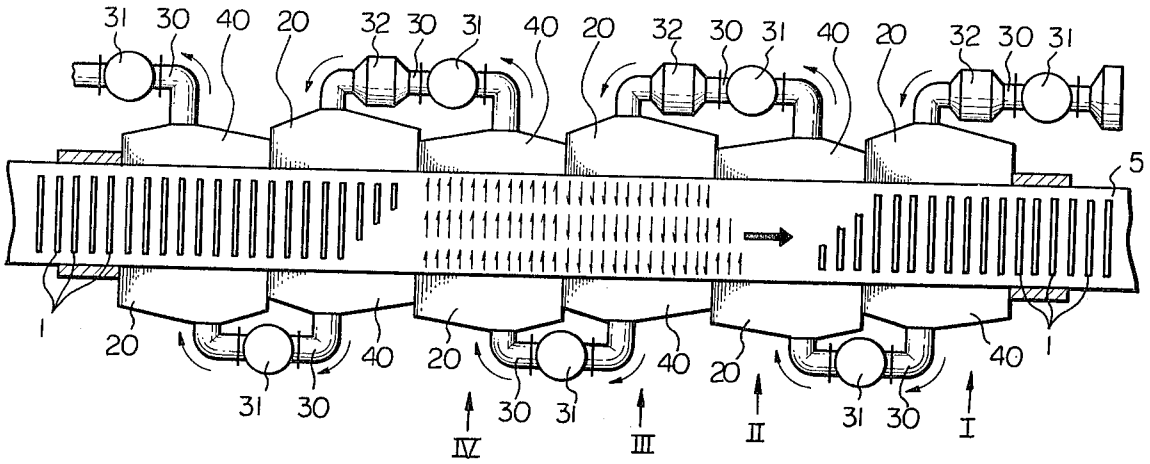
FIG. 9 is a fragmentary plan view of one embodiment of the thermo-pneumatic apparatus in accordance with the present invention.

One embodiment of such an arrangement is shown in FIG. 9, in which the panels 1 with the cowhides move in a direction shown with a thick arrow through the drying chamber 5.

In the first section I, a hot air blower 20 is arranged on one side of the drying chamber 5 whereas a hot air collector 40 is arranged on the other side of the drying chamber 5. In the second section II, a hot air blower 20 is arranged on the above-described other side of the drying chamber 5 whereas a hot air collector 40 is arranged on the above-described one side of the drying chamber 5. In the third section III, a hot air blower 20 is arranged on the above-described one side of the drying chamber 5 whereas a hot air collector 40 is arranged on the above-described the other side of the drying chamber 5. In the fourth section IV, a hot air blower 20 is arranged on the above-described other side of the drying chamber 5 whereas a hot air collector 40 is arranged on the above-described one side of the drying chamber 6.

More generally, each section is provided with a hot air blower 20 arranged on one side of the path of travel of the panels 1 and a hot air collector 40 arranged on the other side of the path of travel of the panels 1, and the hot air blowers 20 and the hot air collectors 40 are arranged alternately from section to section on either side of the travelling path of the panels 1. A pair of neighbouring hot air blower 20 and collector 40 on a common side are connected to each other by a duct 30 via a fan 31. Some of the connections further include heaters 32 arranged downstream of the associated fans 31.

With the above-described construction of the drying chamber 5, the hot air flows from one side towards the other side through the spaces between the panels 1 in the first section I, from the other side towards the one side in the second section II, again from the one side towards the other side in the third section III, and again from the other side to the one side in the fourth section IV.

More generally, the hot air flows alternately in opposite directions from section to section. Consequently, as a panel 1 travels from section to section through the drying chamber 5, cowhides on the panel 1 are heated for drying alternately from different sides. This alternate heating from different sides assures ideally an even drying effect over the entire cowhide.

In accordance with requirement in practice, the hot air may be discharged out of the system and outside air with relatively low moisture content may be introduced into the system.

Although the above-described explanation of the present invention is made in reference to the drying process of cowhides, the invention can be advantageously applied to any heating process of flat materials which travel one after another along a prescribed path. The invention is further applicable to any cooling process of flat materials which travel one after another along a prescribed path. For example, the thermo-pneumatic apparatus shown in FIG. 9 can be used for cooling of heated aluminum plates only by replacing the heaters with suitable coolers. Thus, the thermo-pneumatic unit and apparatus of the present invention is generally applicable to thermal treatment of various flat materials travelling one after another along a prescribed path.

The purposely deflected parallel air flow with specially designed distribution of mass velocity in accordance with the present invention assures an overall even thermal effect on animals' hides to be thermally treated, successful elimination of initial local variance in moisture content of the animals' hides, and a remarkable saving in the thermal energy to be consumed for treatment.

We claim:

1. An improved thermo-pneumatic unit for thermal treatment of travelling flat animal hides, comprising:

means for transporting a plurality of animal hides in a vertically disposed spread state along a prescribed travel path in parallel planes and spaced relationship to each other, the planes including said spread animal hides being substantially perpendicular to said travel path;

a blower of hot air arranged close to one lateral side of said travel path and having an outlet for said hot air facing said travel path, said blower including means for generating a laminar flow of hot air, deflection means between said outlet and said travel path for downwardly directing at least a lower portion of said hot air flow, and means for controlling the mass/velocity distribution of said laminar flow in such a manner that the mass flow rate of said flow is higher adjacent the lower portion of said outlet, said downwardly directed lower portion of said hot air flow rising as said lower portion of said flow approaches the hides, so that a relatively high mass flow of hot air traverses the center portion of each of said animal hides, said center portion having a relatively high initial moisture content as compared with the remainder of the hide; and means for supplying said hot air to said blower.

2. The unit according to claim 1, wherein said deflection means comprises a plurality of spaced apart horizontal lattices arranged in vertically superimposed relationship to each other and extending substantially parallel to said travel path.

* * * * *